US007614393B1

(12) United States Patent
Lu

(10) Patent No.: US 7,614,393 B1
(45) Date of Patent: Nov. 10, 2009

(54) CHANNEL GUN MAGNETIC LAUNCHER

(76) Inventor: Weimin Lu, 39577 Squire Rd., Novi, MI (US) 48375

( * ) Notice: Subject to any disclaimer, the term of this patent is extended or adjusted under 35 U.S.C. 154(b) by 0 days.

(21) Appl. No.: 12/258,729

(22) Filed: Oct. 27, 2008

(51) Int. Cl.
*F41B 6/00* (2006.01)

(52) U.S. Cl. ..... 124/3; 89/1.7; 89/8

(58) Field of Classification Search ..... 124/3; 89/1.7, 8; 102/517, 501
See application file for complete search history.

(56) References Cited

U.S. PATENT DOCUMENTS

| | | | | |
|---|---|---|---|---|
| 4,698,532 | A | 10/1987 | Ross | |
| 4,858,511 | A | 8/1989 | Jasper, Jr. | |
| 4,922,800 | A | 5/1990 | Hoffman | |
| 4,944,212 | A | 7/1990 | Hilal | |
| 4,960,760 | A | 10/1990 | Wang et al. | |
| 5,005,462 | A | 4/1991 | Jasper, Jr. et al. | |
| 5,017,549 | A | 5/1991 | Bobertson | |
| 5,173,568 | A | 12/1992 | Parmer | |
| 5,237,904 | A | 8/1993 | Kuhlmann-Wilsdorf | |
| 5,375,504 | A | 12/1994 | Bauer | |
| 5,431,083 | A | 7/1995 | Vassioukevitch | |
| 5,454,289 | A | 10/1995 | Bacon et al. | |
| 5,847,474 | A | 12/1998 | Gruden et al. | |
| 6,142,131 | A * | 11/2000 | Wortman et al. | 124/3 |
| 6,622,713 | B1 | 9/2003 | Thomas | |
| 6,757,187 | B2 | 6/2004 | Hoenigschmid | |
| 6,775,187 | B1 | 8/2004 | Hamilton et al. | |
| 7,348,591 | B2 | 3/2008 | Yamauchi et al. | |
| 7,459,807 | B2 * | 12/2008 | Putman et al. | 310/12 |
| 2008/0053299 | A1 * | 3/2008 | Taylor | 89/8 |

OTHER PUBLICATIONS

Harry Fair, "The Electromagnetic Launch Technology Revolution", Magnetics Magazine, Winter 2003, Webcom Communications Corp., Greenwood Village, CO., USA.

* cited by examiner

*Primary Examiner*—J. Woodrow Eldred
(74) *Attorney, Agent, or Firm*—Carrier, Blackman & Associates P.C.; Joseph P. Carrier; William D. Blackman

(57) ABSTRACT

An electromagnetic launcher comprising, an electric power supply, a conductive, stationary guide operatively connected to the power supply and forming a flowpath for current from the power supply, and a non-conductive projectile disposed adjacent to the guide and which is accelerated along the guide when current flows through the guide. The guide includes a plurality of conductive rails disposed in spaced, substantially parallel relation to each other, a plurality of conductive rungs interconnecting the rails and disposed in spaced relation to each other along the rails, and normally-open switches operatively associated with the rungs for selectively permitting current flow through different ones of the rungs. The projectile includes a main body and a magnet supported by the main body such that the magnet faces the guide with a small gap therebetween. The switches are passively activated only when they are disposed within a magnetic field of the projectile, such that the switches are sequentially activated as the projectile moves along the guide and create an electromagnetic pushing Lorentz force which continuously accelerates the projectile along the guide substantially in a direction parallel to the guide.

20 Claims, 14 Drawing Sheets

CHANNEL GUN MAGNETIC LAUNCHER

BACKGROUND OF THE INVENTION

1. Field of the Invention

The present invention relates to an electromagnetic projectile launcher, and in particular, to an electromagnetic projectile launcher wherein the projectile is continuously accelerated to a high velocity in a very efficient manner involving minimal physical contact and essentially no electrical conductivity between the launcher and the projectile.

2. Description of the Background Art

Known electromagnetic accelerators have been designed to accelerate and launch projectiles at high velocities. An example of such an electromagnetic accelerator is a rail gun, which consists of parallel conductive sliding or rolling rails and a conductive projectile riding along such conductive rails, which together form a closed electrical circuit. When the parallel conductive rails are connected to a power supply, the conductive sliding or rolling rails allow a large electric current to pass through the projectile. Electric current runs from one terminal of the power supply, up one conductive rail, across the projectile and down the other conductive rail to the other terminal of the power supply. This flow of the current creates a powerful magnetic field between the conductive rails and up to the projectile. This magnetic field in connection with the current across the projectile creates a Lorentz force which substantially continuously accelerates the projectile along the rails away from the power supply.

An example of such a rail gun is found in U.S. Pat. No. 6,662,713 to Thomas, which discloses a rail gun which uses magnetic forces to accelerate a round held within the firing chamber of a gun. A pair of rails extend along a length of the firing chamber and each has at least one wire passing therethrough. At least one toroid magnet encompasses the rails as does a solenoid magnet. The wires within the rails, the toroid magnet and the solenoid magnet are each electrically coupled to an electrical source with electrical communication established by a trigger. A magnetically sensitive round held within the firing chamber is initially accelerated by the rails, then further accelerated by the toroid magnet and then further accelerated by the solenoid magnet prior to being discharged from the firing chamber.

While rail guns are in principle very simple, they have several known disadvantages, making them practically difficult. One known disadvantage is that, since the projectile must be in constant physical contact and electrical conductivity with the rails to let electric current flow as the projectile is being launched, large amounts of heat are generated between the moving projectile and the rails which burns the rails thereby causing significant and rapid wear of the rails. Thus, many rail guns can only be used for a single application or a small number of applications due to the damaged to the rails.

In order to avoid the direct physical contact between the rails and the projectile, another type of rail gun uses plasma arcing. As with the conventional rail guns described above, a rail gun which uses plasma arcing is composed of two parallel arranged current-conducting rails which are connected with a high-intensity current source. To accelerate the projectile, the trailing end of the projectile has an armature that acts as a current bridge between the two rails. Plasma is used to constitute the armature (plasma armature). As with the conventional rail gun, current flows from the large power supply through one rail and through the electric arc, down the other rail and back to the power supply. Again, a magnetic field is generated in this current loop which causes an electromagnetic force (Lorentz force) thereby accelerating the arc and thus also the projectile in front of the arc. However, while plasma arcing allows for the projectile to not come directly into contact with the rails, a rail gun using a plasma armature generates an even higher amount of heat than a conventional rail gun, again, damaging the rails.

Another disadvantage of using a rail gun is that rail guns require an extremely high current DC power source. Rail guns require the current flowing through the rails and the projectile to be in the magnitude of tens of thousands to millions of amperes in order to generate the high velocity of the projectile which is sought. Further, the extremely high current is required to be generated over a very short period of time. Without such a high current generated over such a short period of time, the projectile would fail to be launched at an appropriate velocity. Thus, a power supply which can generate such a high amount of current over such a short period of time is both large in size and expensive.

A second example of an electromagnetic accelerator is a coilgun. A coilgun consists of one or more coils arranged along a barrel with a projectile placed at one end. A high-intensity power supply is attached to one end of the coil or coils and a large electric current is pulsed through the coil or coils. The electrical current running through the coil creates a large magnetic field which pulls the projectile to the center of the coil. An electrical current running through a coil which thereby creates a magnetic field is called an electromagnet. Once the projectile is near the center of the electromagnet, the current being supplied to the coil is shut off, and the next electromagnet is turned on such that the projectile is then pulled toward the center of the next electromagnet. This process of switching on and off the electromagnets is repeated with each coil along the barrel of the coilgun until the projectile moves at an appropriate speed and is launched from the coilgun. The switching on and off of the electromagnets within the coil guns occurs at a rapid pace so as to ensure that the projectile is accelerated quickly along the barrel.

Coilguns are beneficial in that coilguns have no sliding contact with the projectile, such that no wear or erosion occurs to the barrel except some physical restraint to keep the projectile along the center, and the working life of a coilgun is potentially infinite, unlike the working life of a rail gun.

However, there are other disadvantages associated therewith. For example, a known disadvantage of coilguns is the switching of the power through the coils. Each coil inherently has a certain substantial amount of inductance which will prevent precision switching between on and off of the power to the coils. As such, a precision control circuit to turn on and off each coil depending on the position of the projectile must be added to the coilgun.

Another disadvantage of a coilgun is that since the magnetic coil attracts the magnetic material (projectile) toward the center of the coil, each coil only attracts the projectile for substantially half the length of the coil and the projectile travels by itself the remaining half/portion of the coil. As such, a coilgun has segmented acceleration, causing the projectile to begin slowing down before being accelerated again by the next coil. This is inherently inefficient.

A further disadvantage of a coilgun is the rate at which the projectile becomes saturated by the magnetic field and the rate at which it loses its magnetic saturation. Once an object becomes saturated, the amount of force by which it can be attracted stops increasing. The rate at which the projectile loses its saturation is a critical factor. As this rate is constant, greater distances between drive electromagnets are needed to compensate for this rate, and as the projectile increases in speed it reaches drive electromagnets at progressively faster rates. Without compensation for desaturation time, there will be less and less affect on the velocity of the projectile per coil, resulting in significantly lower efficiency per drive electromagnet stage as the projectile travels down the line. Once the amount of force exerted to the projectile is less than or equal to the amount of resistance exerted on the projectile due to air friction, friction in the barrel, etc., the projectile will no longer accelerate.

Still further, other known electromagnetic launchers include induction coil launchers, such as ring launchers or eddy-current launchers. Induction coil launchers create an induced current on the projectile which repels the source current within the body of the induction coil launcher. The induced current on the projectile causes the projectile to move towards the lesser reaction thereby pushing the projectile forward. While the induction coil launcher initially quickly accelerates the projectile, induction coil launchers have the disadvantage that the projectile decelerates before being lunched.

Although some of the disadvantages of conventional electromagnetic launching systems have been addressed, as discussed above, a need still exists in the art for an improved, more efficient electromagnetic launching system which more completely addresses all of the disadvantages attendant the conventional systems. In particular, there is a need for such an improved system that may continuously and efficiently accelerate a projectile but which does not involve electrical contact between the projectile and the rails of the launcher so as to ensure a long working life and permit the use of a comparatively smaller power supply.

SUMMARY OF THE INVENTION

The present invention has been created with the intention of meeting the discussed need. Accordingly, an aspect and advantage of the present invention is its ability to overcome the deficiencies in prior art electromagnetic launchers by providing an improved electromagnetic launcher in accordance with the disclosure herein.

According to a first aspect and feature of the present invention an electromagnetic launcher is provided for use in accelerating a projectile to hypervelocity (a velocity approximately 3,000 meters per second or greater), the electromagnetic launcher comprising: an electric power supply; a conductive, stationary guide operatively connected to the power supply and forming a flowpath for current from the power supply; and a non-conductive projectile disposed adjacent to the guide and which is accelerated along the guide when current flows through the guide, the guide including a plurality of conductive rails disposed in spaced, substantially parallel relation to each other, a plurality of conductive rungs interconnecting the rails and disposed in spaced relation to each other along the rails, and normally-open switches operatively associated with the rungs for selectively permitting current flow through different ones of the rungs. The projectile of the electromagnetic launcher includes a main body and a magnet supported by the main body such that the magnet faces the guide with a small gap therebetween. The switches are passively and automatically activated only when they are disposed within a magnetic field of the projectile, such that the switches are sequentially activated as the projectile moves along the guide and creates an electromagnetic pushing force which continuously accelerates the projectile along the guide substantially in a direction parallel to the guide.

The electromagnetic launcher according to the first aspect and feature of the present invention is very advantageous over conventional launchers such as rail guns and coil guns, and desirably combines favorable characteristics of the prior launchers, without the attendant disadvantages. For example, the projectile of the present invention is non-conductive and does not form part of the current flow path with the power supply and the guide, unlike in a rail gun where the current flows through the conductive projectile, as well as through the rail. Thus, the non-conductive projectile is not forced into electrical contact with the guide, but moves parallel to the guide with little or no physical contact therebetween, and there is no electric arcing on the projectile, such that the guide is not tremendously heated and destroyed each time a projectile is launched. Unlike conventional rails guns wherein the guide can only be used for a single or small number of launches due to the heat and destruction caused during a launch, the guide of the launcher according to the present invention may be reused repeatedly for launching many projectiles.

As another example, only one or a small number of the guide rungs are directly adjacent to the projectile at any given time and such that the switch(es) associated therewith are activated to permit current flow through the rungs. Thus, the launcher according to the present invention may be considered to have essentially only one turn for the current flowing from the power supply and through the guide at any given time. Correspondingly, there is minimum inductance associated with the launcher/guide, unlike the conventional coil gun which has substantial inductance associated therewith, such that the switches associated with the guide rungs can be sequentially turned on at extremely fast speeds as the projectile moves along the guide. This permits the projectile of the present invention to be substantially, continuously accelerated, similar to a projectile being launched by a rail gun, except that present invention is much more efficient because it does not waste energy due to heat being generated by significant frictional contact and arcing between the projectile and the guide.

As still another example, the launcher according to the first aspect and feature of the present invention has a relatively simple structure in comparison to a coil gun because the switches are normally open and passively/automatically activated exclusively by the presence of the projectile as it moves along the guide, again, resulting in a substantially continuous acceleration of the projectile as it speeds along the guide. In this arrangement, it is not required to use a controller, sensors, etc. to activate the switches at an appropriate timing, which is contrary to the structure of a coil gun, and results in a significant cost reduction in comparison to the coil gun.

According to a second aspect and feature of the present invention, an electromagnetic launcher is provided for use in accelerating an object to hypervelocity, the electromagnetic launcher comprising: an electric power supply; a conductive, stationary guide operatively connected to the power supply and forming a flowpath for current from the power supply, the guide including a plurality of rails disposed in spaced, substantially parallel relation to each other, and a plurality of rungs interconnecting the rails and disposed in spaced relation to each other along the rails; a non-conductive projectile disposed adjacent to the guide and which is accelerated along the guide when current flows through the guide, the projectile includes a main body and a magnet supported by the main body such that the magnet faces the guide with a small gap therebetween; switches operatively associated with the rungs for selectively permitting current flow through different ones of the rails; and a controller which selectively activates the switches only when they are disposed in close proximity to the projectile, such that the switches are sequentially activated as the projectile moves along the guide and create an electromagnetic pushing force which continuously accelerates the projectile along the guide substantially in a direction parallel to the guide.

The electromagnetic launcher according to the second aspect and feature of the present invention is very advantageous over conventional launchers such as rail guns and coil guns, for many of the same reasons as discussed in relation to the first aspect and feature. Again, for example, the projectile of the present invention is non-conductive and does not form part of the current flow path with the power supply and the guide, unlike in a rail gun where the current flows through the conductive projectile, as well as through the rail. Thus, again, the guide according to the second aspect and feature is not tremendously heated and destroyed each time a projectile is launched, and may be reused repeatedly for launching many projectiles.

Also, again, only one or a small number of the guide rungs is directly adjacent or in close proximity to the projectile at any given time, such that the switch(es) associated therewith are activated to permit current flow through the rungs. Thus, the launcher according to the second aspect and feature may also be considered to have essentially only one turn for the current flowing from the power supply and through the guide at any given time, such that there is minimum inductance associated with the launcher/guide, and the switches associated with the guide rungs can be sequentially turned on at extremely fast speeds as the projectile is accelerated along the guide. Again, this permits the projectile of the present invention to be substantially, continuously accelerated, similar to a projectile being launched by a rail gun, except that present invention is much more efficient because it does not waste energy due to heat being generated by significant frictional contact and arcing between the projectile and the guide.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

DETAILED DESCRIPTION OF THE PRESENT EMBODIMENTS

Figure 1:
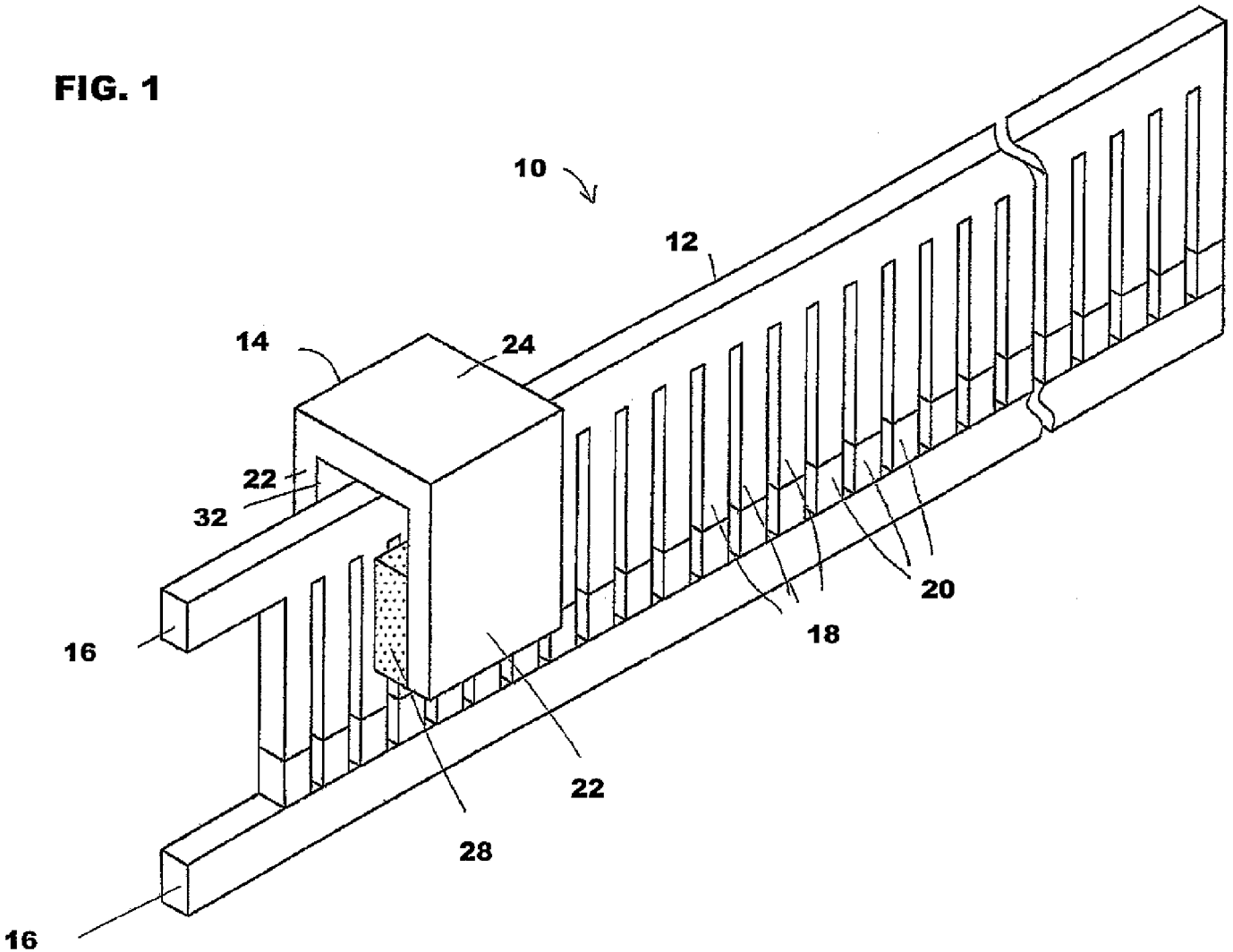
FIG. 1 is a perspective view of an electromagnetic launcher having a U-shaped projectile according to an illustrative embodiment of the present invention.

A number of selected illustrative embodiments of the invention will now be described in some detail, with reference to the drawings. It should be understood that only structures considered necessary for clarifying the present invention are described herein. Other conventional structures, and those of ancillary and auxiliary components of the system, are known and understood by those skilled in the art. These illustrative embodiments are electromagnetic launchers and various components of such systems.

Referring now to the FIGS. 1-3 and 5, there is shown an electromagnetic launcher according to a first illustrative embodiment of the present invention, generally denoted by reference numeral 10, which is generally comprised of a conductive body member 12, hereinafter referred to as a guide or an electric ladder, having a switching mechanism integrally associated therewith, a projectile 14 arranged thereon and an electric power supply 36 connected to the electric ladder. The electric ladder 12 may comprise a pair of electrically conductive, substantially parallel longitudinal rails 16 which are connected by a plurality of conductive rungs 18 spaced from each other along the rails. The longitudinal rails 16 and rungs 18 may be made substantially of copper or other appropriate conductive material or may be formed such that a plurality of wires (not shown), which are formed of copper or other appropriate conductive material, are provided therein.

Further, each conductive rung 18 may be integrally provided with a high-speed switch 20. The switch 20 may be a normally-open type which does not permit current flow through the rung when deactivated, and is closed when activated to permit current flow through the rung, and thereby completing an electrical circuit from the power supply 36 and through the ladder 12.

The projectile 14 may include a main body formed in a substantially U-shape having a pair of substantially parallel longitudinal sides 22 connected at one end by an end portion 24. The main body may be formed of appropriate ferromagnetic material, which that the frame can carry magnetic flux through to form the magnetic field loop. A first permanent magnet 28 is attached to the inner portion 26 of one of the longitudinal sides 22 of the U-shaped projectile 14, and a second permanent magnet 30 is attached to the inner portion 32 of the other longitudinal side 22 of the U-shaped projectile 14. The first permanent magnet 28 may be attached to the inner portion 26 such that the south pole of the magnet 28 is adjacent to the inner portion 26 of the longitudinal side 22, and the second permanent magnet 30 may be attached to the inner portion 32 such that the north pole of the magnet 30 is adjacent to the inner portion 32 of the second longitudinal side 22. As such, the north pole of the first permanent magnet 28 faces the south pole of the second permanent magnet 30 through the electric ladder 12. Thus, the U-shaped frame of the projectile 14 bridges the magnetic field from the first permanent magnet 28 and the second permanent magnet 30 together to form a closed magnetic loop in order to reach maximum magnetic flux density.

Figure 2:
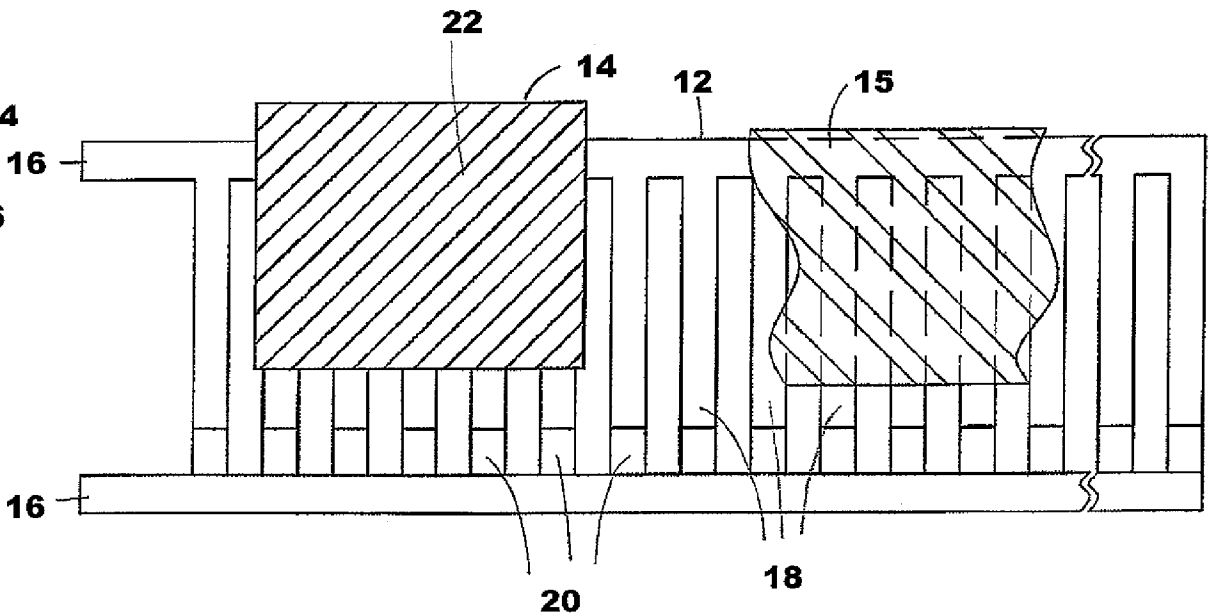
FIG. 2 is a side view of the electromagnetic launcher of FIG. 1.
Figure 3:
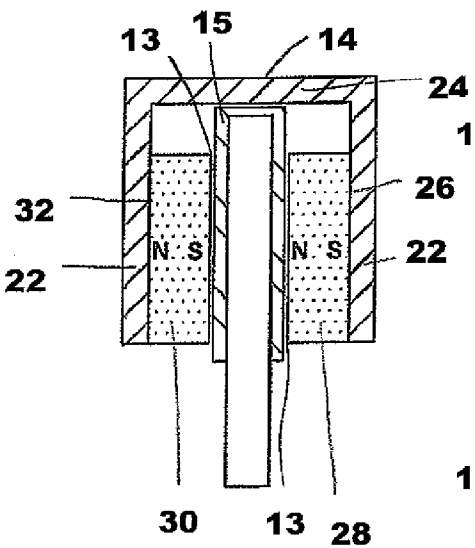
FIG. 3 is an end view of the electromagnetic launcher of FIG. 1.

The projectile 14 may be positioned such that the upper portion of the electric ladder 12 is disposed within the open portion of the U-shaped projectile 14 adjacent to the magnets 28, 30 with small air gaps 13 provided between the surfaces of the magnets 28,30 and the electric ladder 12 to allow for some movement of the projectile 14 relative to the ladder. Also, as seen in FIGS. 2-3, the sides of the electric ladder 12 may be coated in a non-conductive, low friction material 15, in order to minimize any friction that may occur or heat which may be produced by any contact between the projectile including permanent magnets 28, 30 and the electric ladder 12. As an alternative to the coating 15, member(s) formed of the low friction material may be provided on the electric ladder 12 or on the surfaces of the magnets 28, 30. Also, the conductive rungs 18 of the electric ladder 12 are positioned in the middle of the magnetic field created by the first permanent magnet 28 and the second permanent magnet 30. By placing the electric ladder 12 in the middle of the magnetic field, the conductive rungs 18, and the electric ladder 12, are maintained directly in the middle of the longitudinal sides 22 of the projectile such that the projectile 14 has minimal physical contact with the electric ladder 12. Although a pair of permanent magnets 28, 30 are used in the above embodiment, it is possible to use a single magnet, or to use electromagnet(s) with an appropriate power source.

According to an important aspect of the present invention, the switches 20 of the first illustrative embodiment may be constructed such that they are automatically activated in the presence of a magnetic field, or in other words when they are in close proximity to the projectile 14 with the permanent magnets 28, 30. To accomplish this, each switch 20 may include a semiconductor material which selectively allows and inhibits electric current flow therethrough, such as a magnetroresistive semiconductor material. Examples of such a magnetoresistive switches can be found in U.S. Pat. Nos. 6,757,187, 6,775,187 and 7,348,591 and in Akinaga Hiroyuni. "Magnetoresistive Switch Effect in Metal/Semiconductor Hybrid." 2002 *Semiconductor Sci. Technol.* 17, 322-326, the disclosures of which are incorporated herein by reference. Currently, there are many types of magnetoresistive switches under development. By this, each switch 20 may be formed directly as part of the corresponding rung conductive 18 such that the rung 18 will only conduct electric current between the rails 16 in the presence of a magnetic field, such as that created by the projectile 14, and will inhibit current flow when not in the presence of the magnetic field.

According to another important aspect of the present invention, only one or a small number of the conductive rungs 18 are directly adjacent to the projectile at any given time, such that the switch(es) 20 associated therewith are activated to permit current flow through the rungs 18, as discussed further below. Thus, the launcher 10 may be considered to have only one turn for the current flowing from the power supply and through the electric ladder 12 at any given time. Correspondingly, there is minimum inductance associated with the launcher 10/electric ladder 12 such that the switches 20 associated with the conductive rungs 18 can be sequentially turned on at extremely fast speeds as the projectile 14 moves along the electric ladder 12. This permits the projectile 14 to be substantially, continuously accelerated along the entire length of the electric ladder 12 without wasting energy due to heat being generated by significant frictional contact and arcing between the projectile and the guide.

Figure 5:
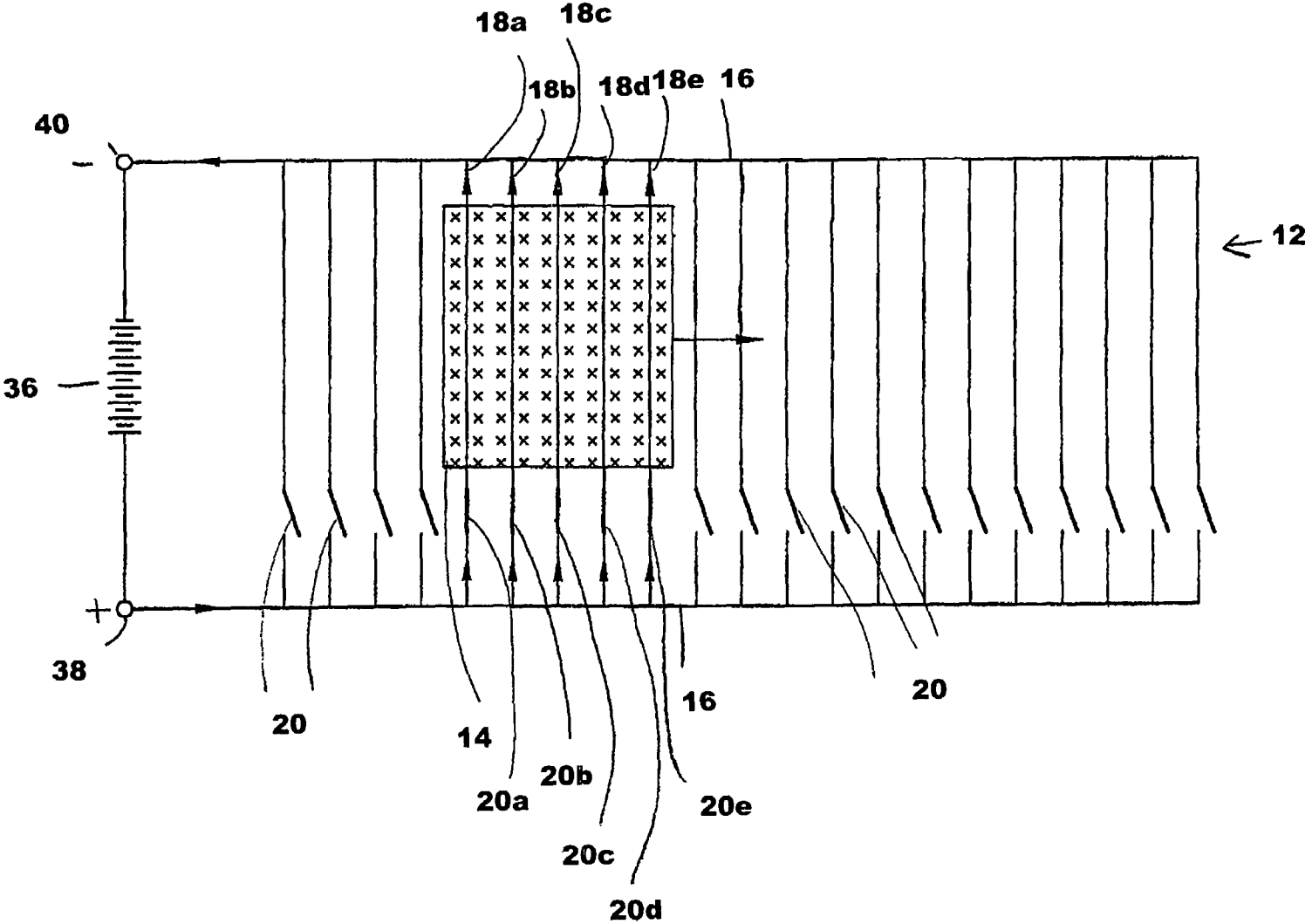
FIG. 5 is an electrical schematic corresponding to the electromagnetic launcher of FIG. 1 or FIG. 4.

Referring now to FIG. 5, which shows an electrical schematic of the electromagnetic launcher according to the first illustrative embodiment of the present invention in which the longitudinal rails 16 of the guide 12 are electrically coupled to the electrical power supply 36. While the electrical power source 36 is preferably a DC power supply, an AC power supply may be substituted if an ample current supply can be generated.

Figures 6A, 6B, 6C:
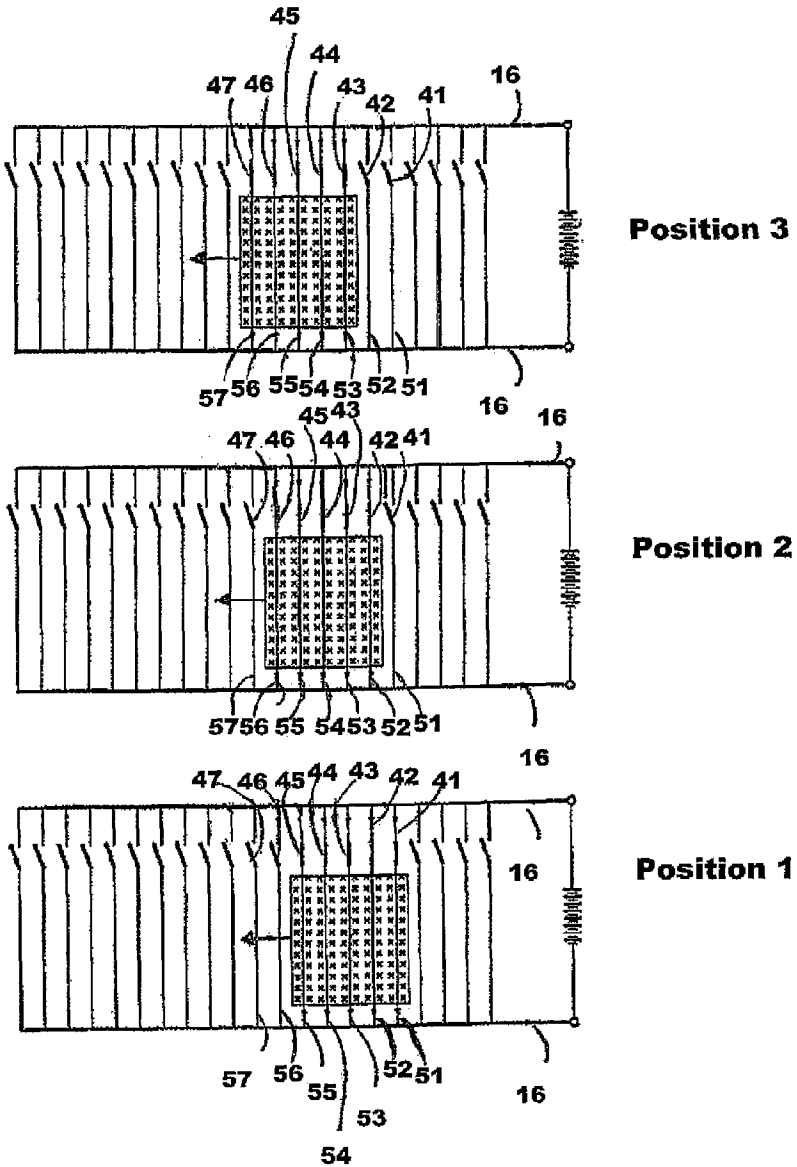
FIGS. 6A-6C are similar to FIG. 5, but show progressive movement of the projectile along the rails.

Electric current flows from a positive terminal 38 of the electric power supply 36 along the first of the longitudinal rails 16. When the projectile 14 is placed on the electric ladder 12, the magnetic field created by the two permanent magnets 28, 30 of the projectile 14 causes the switches located within the electric field, e.g., 20*a*, 20*b*, 20*c*, 20*d*, 20*e*, to be closed/activated, while the remainder of the switches 20 remain open. By closing the switches, the electrical current which has been directed up the first of the longitudinal rails 16 is then directed across the respective conductive rungs 18*a*, 18*b*, 18*c*, 18*d*, 18*e* including the closed switches 20. As such, the electrical current is only supplied through a small number of the conductive rungs wherein the associated switch has been closed or activated in the presence of the projectile 14. The current then flows back along the second of the longitudinal rails 16 and back to the negative terminal 40 of the power supply 36. When the projectile is moving and accelerating and as soon as a switch is no longer within the magnetic field created by the magnets 28, 30, the switch is reopened and current is no longer directed through the respective conductive rung. Generally, based on the presence of an electrical charge (or charged particle) within a magnetic field, a force is exerted on the charged particle, and is known as a Lorentz force. It is given by the following Equation A in terms of the electric and magnetic fields:

$$F=q[E+(v*B)], \qquad \text{(Equation A)}$$

where F is the force, E is the electric field, B is the magnetic field, q is the electric charge of the particle, and v is the instantaneous velocity of the particle. Such force will cause the positively charged particle, in this case the respective conductive rungs, to move or accelerate in the same direction as the electrical field. However, with the electromagnetic launcher of the present illustrative embodiment, the electric guide or ladder 12, including the conductive rungs 18, is mounted so as to be fixed/stationary and can not be moved by the exerted Lorentz force. Instead, the Lorentz force functions to move/accelerate the projectile 14 away from the charged particle/conductive rung. The Lorentz force thus generated is directed perpendicular to the conductive rungs 18 and parallel to the longitudinal rails 16, and accelerates in the longitudinal direction of the electric ladder 12. Again, as the projectile 14 progressively moves along the electric ladder 12, the front end of the projectile 14 sequentially causes the switch 20 in the next consecutive conductive rung in the moving direction to close, causing electrical current to flow through the conductive rung. As the front end of the projectile 14 is accelerated toward the next consecutive rung, the rear end of the projectile 14 is also accelerated forward, thereby sequentially causing the most rearward conductive rung to move out of the magnetic field, thus deactivating and opening the switch 20 in the associated conductive rung. When the switch is opened, electrical current is no longer allowed to flow through the conductive rung. Such sequential operation of the switches 20 is seen best in FIGS. 6A-C, wherein the projectile is continuously accelerated along the length of the electric ladder 12. In FIG. 6A, for example, the projectile 14 is in position 1, wherein switches 41, 42, 43, 44 and 45 are closed, thus conducting current flow through conductive rungs 51, 52, 53, 54 and 55. As the Lorentz force moves the projectile 14 forward, switch 46 is closed, thereby conducting electricity through conductive rung 56, and electrical switch 41 is opened thereby inhibiting electricity flow through conductive rung 51. As the projectile continues to accelerate forward, switch 47 is closed, thereby conducting electricity through conductive rung 57, and electrical switch 42 is opened, thereby inhibiting electricity flow through conductive rung 52. This cycle automatically continues until the rear end of the projectile 14 reaches and is forced away from the conductive rung at the end of the electric ladder 12 which is opposite the electric power supply 36, and by which time the projectile will be moving at hypervelocity. Generally, it is desirable that the length of the projectile is such that it covers a small number (more than one) of the rungs at any given time. This avoids or minimizes an internal energy surge and collapse of the rung switches if only one rung was activated at any given time.

In order to increase or decrease the launching speed of the projectile, the length of the electric ladder may be increased or decreased, the output of the power supply 36 may be varied, the size/mass of the projectile 14 may be varied, etc. Again, once the projectile 14 is being moved/accelerated by the Lorentz forces, the projectile 14 does not come into substantial physical contact with any portion of the electric ladder 12, because the projectile is primarily supported by the Lorentz forces. Thus, due to the Lorentz forces and the low friction material/members 15, there is minimal friction or heat generated as the projectile 14 is accelerated along the electric ladder 12, such that the electric ladder 12 is not significantly damaged by launching of the projectile allowing the electromagnetic launcher 10 to be used multiple times.

Further, since the electromagnetic launcher of the present invention uses no electrical arcing on the projectile, there is less energy dissipated/wasted and heat generated. Thus the electromagnetic launcher 10 of the present invention may use a smaller energy supply with an extended length ladder to achieve hypervelocity speeds, whereby the present invention eliminates the conventional need for an extremely high current power supply and consumes less energy per launch.

Figure 4:
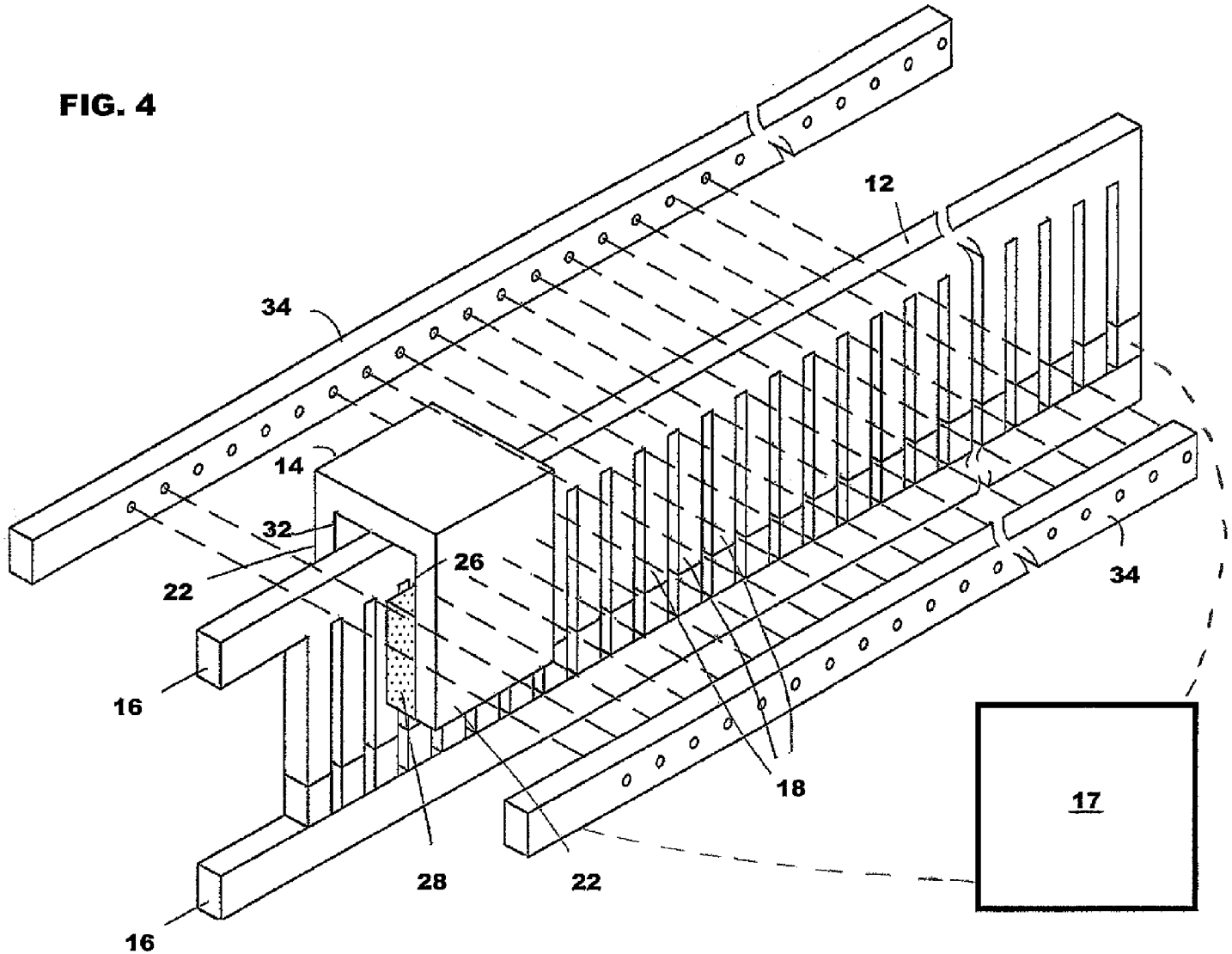
FIG. 4 is a perspective view of an electromagnetic launcher having a U-shaped projectile according to another illustrative embodiment of the present invention, which is similar to the launcher of FIG. 1, but includes a sensor arrangement for triggering the switches.
Figure 20:
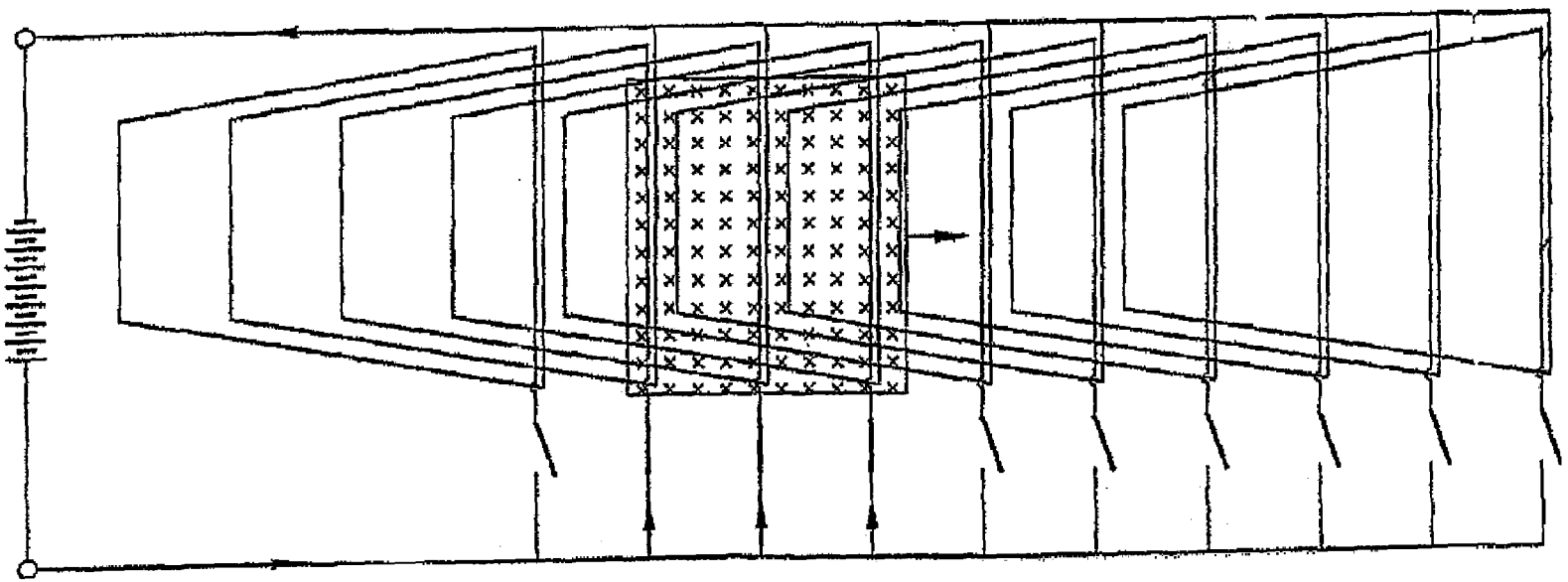
FIG. 20 is an electrical schematic showing an electromagnetic launcher having looped conductive rungs according to an embodiment of the present invention.

Although the embodiments of FIGS. 1-3 and 5 desirably includes a switching mechanism which simply, automatically actuates the switches based on the presence of the projectile 14 accelerating at ever increasing speeds, it is possible to use other switching mechanisms. For example, while the switches 20 may be made from a magnetroresistive material with an automatic switching function, any appropriate electrical, electronic, or mechanical switch which will allow and inhibit the flow of current when in the presence of the projectile can be used, e.g. an ultra-fast, high speed electronic switching circuit such as a MOSFET switch with optical sensors, and electrical switch such as a relay, a mechanical switch such as a commuter switch, etc. With such other switches it may be necessary to include a controller for controlling operation of the switches at an appropriate timing to properly accelerate the projectile to hypervelocity. An embodiment of the present invention including a MOSFET switch with optical sensors is shown in FIG. 4. As seen in FIG. 4, the switches 20 are not required to be formed wholly adjacent to or within the conductive rungs 18. A high speed electronic switching circuit, such as a MOSFET switch with optical sensors 34, may be used to detect the presence of the projectile 14 and the switching speed on each rung can be matched with the position of the accelerating projectile. When the presence of the projectile 14 is detected by the optical sensors 34, the sensors sends a signal to a controller 17 which then selectively activates the switches within the rungs 18 adjacent to the projectile 14 and thus allow electricity to be flow through different ones of the conductive rungs 18 such that the rungs are sequentially activated as the projectile moves along the electric ladder 12. In a practical application using ultra fast switching circuitry, e.g., power MOSFETS with optical position sensors, the speed at which the switches are activated and deactivated can be matched with the position of the accelerating projectile. Another modification to the embodiment of FIGS. 1-3 and 5 is shown in FIG. 20. As seen in FIG. 20, the conductive rungs, while still used to connect the rails of the electric ladder, may have a loop-shaped conductor instead of a straight conductor. As depicted, there is a single loop for each conductive rung. This single loop form allows current to run twice through each conductive rung and thus doubles the Lorentz force. Though not shown, each loop-shaped conductor rung may include multiple loops that multiply the Lorentz force to propel the projectile. While this embodiment has an increased inductance, as compared to the previous embodiments, if the number of loops is not excessive, e.g., 50 or less, the amount of inductance can be appropriately limited.

PRACTICAL EXAMPLE OF THE INVENTION

Practical examples of the invention involving the above described embodiments are explained in the examples below.

Example 1

As an example of the embodiment shown in FIG. 4, in calculations with an extended length for the electric ladder and without accounting for air friction, if the conductive rungs are spaced approximately one-eighth (⅛) of an inch apart the switches 20 are capable of being activated and deactivated by the controller 17 at 1 MHz. If the length of the projectile is then set at one (1) inch, a muzzle velocity of the projectile can reach approximately 16,000 miles per hour (mph) or 7 kilometers per second (kmps), which gives the projectile enough kinetic energy to launch it out to space, for example. With such a configuration, each switch may be a 1 MHz MOSFET switch that can easily be activated from the front end of the projectile and can easily be deactivated by the rear end of the projectile. Thus, if the total time which the switch would be activated is 3.6 μs for the one (1) inch projectile to travel, the speed of the projectile would be 1,000,000/3.6*1=277,778 inches per second (which is equal to 4.4 miles per second, 16,000 miles per hour, 7 kilometers per second, or 7000 meters per second. A switch to hold the 3.6 μs on-time requires a MOSFET switch having at least a 0.3 MHz speed. Thus, a 1 MHz MOSFET switch, is more than fast enough for the example application.

Example 2

As en example of the embodiment described above in FIGS. 1-3 and 5, in an ideal scenario wherein there is no friction, the magnetic force F can be calculated using the Lorentz equation, which is reformatted below as Equation B, in SI units, $$F=L*I*B \quad \text{(Equation B)}$$

wherein the magnetic force (F) is measured in Newtons, the length (L) is measured in meters, the current force (I) is measured in amperes, and the magnetic inductance force (B) is measure in Tesla. If in the single turn ladder structure of the first illustrative embodiment, as shown in FIGS. 1-3 and 5, there is a 0.1 meter long Neodymium-iron-born (NIB) magnet with 1 Tesla magnetic field strength, applying 5,000 Amps DC current going through, then: F=L*I*B=0.1*5,000*1=500 Newtons. If the projectile weighs 1 kg, then the acceleration force (A)=Force/mass (F/m)=500/1=500 meters per second squared. Thus if the projectile's beginning velocity is zero, then after one (1) second, the velocity after one (1) second=Acceleration*time(A*t)=500*1=500 meters per second. Thus the length of the electric ladder is S=½ Acceleration*time$^2$(½A*t$^2$)=½*500*12=250 meters.

Example 3

As an example of the embodiment described above in FIG. 20, if instead of the single turn ladder structure of the first illustrative embodiment, we have a the looped conductive rung ladder structure, such as that shown in FIG. 20, and there is a 20-turn loop per rung structure, a 0.1 meter long Neodymium-iron-born (NIB) magnet with 1 Tesla magnetic field strength, and applying 5,000 Amps DC current going through, then the calculations work out as follows: F=L*I*B=(20*0.1)*5,000*1=10,000 Newtons. If the projectile weighs 1 kilogram, then the acceleration force (A)=Force/mass (F/m)=10,000/1=10,000 meters per second squared. Then in order to reach the muzzle speed of 7,000 meters per second, it will take 0.7 seconds. If we are using an elongate electric ladder, the length of the ladder would be S=½ Acceleration*time$^2$(½A*t$^2$)=½*10,000*0.7$^2$=2500 meters or 2.5 km.

While the above-described embodiments of an electromagnetic launcher according to the invention include a guide with a pair of rails interconnected by a plurality of rungs and a U-shaped projectile with a pair of permanent magnets, it is possible to vary the structures of the guide and projectile while achieving essentially the same results. Some possible variations are described below.

Figure 7:
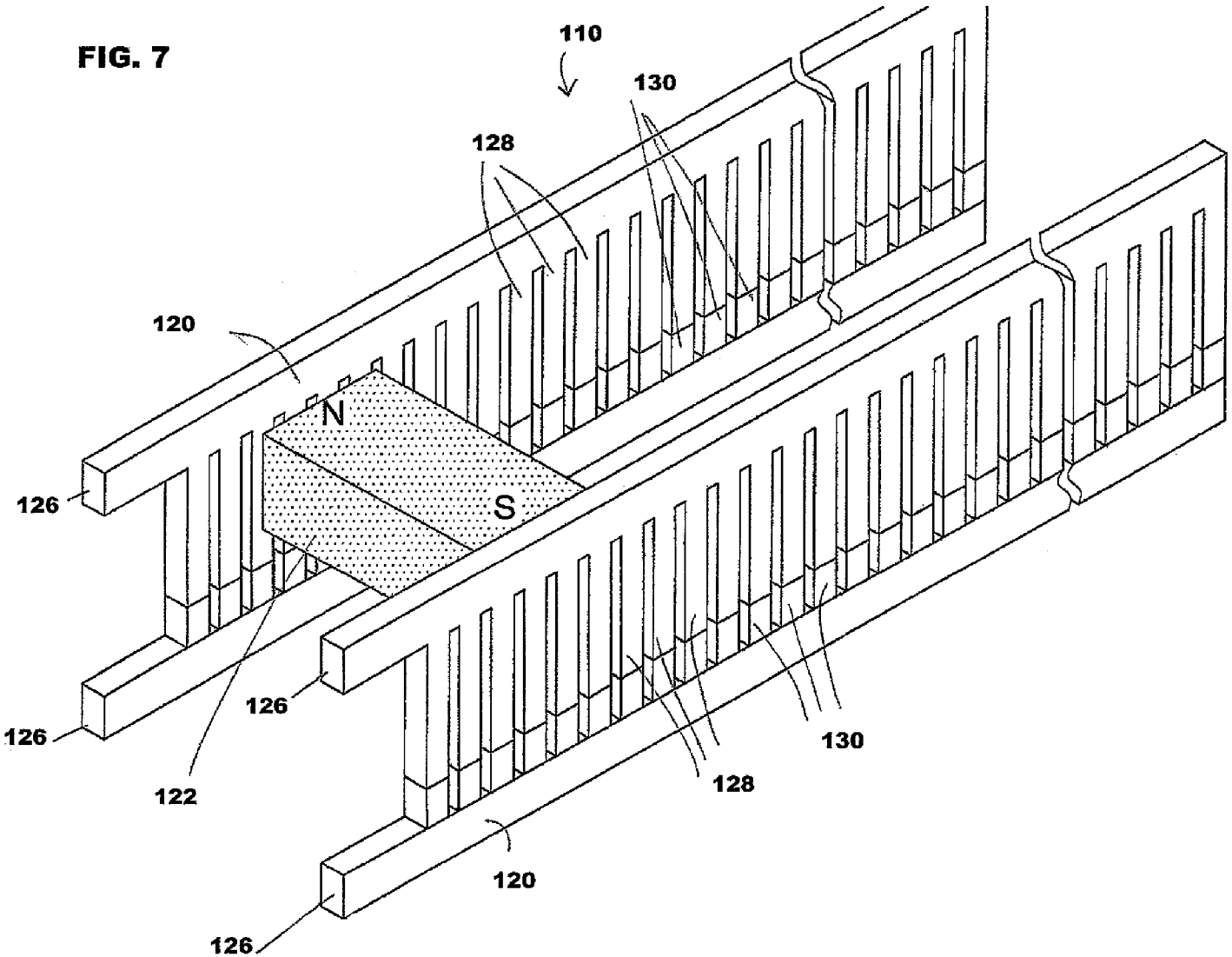
FIG. 7 is a perspective view of an electromagnetic launcher with a block shaped projectile according to another embodiment of the present invention.
Figure 8:
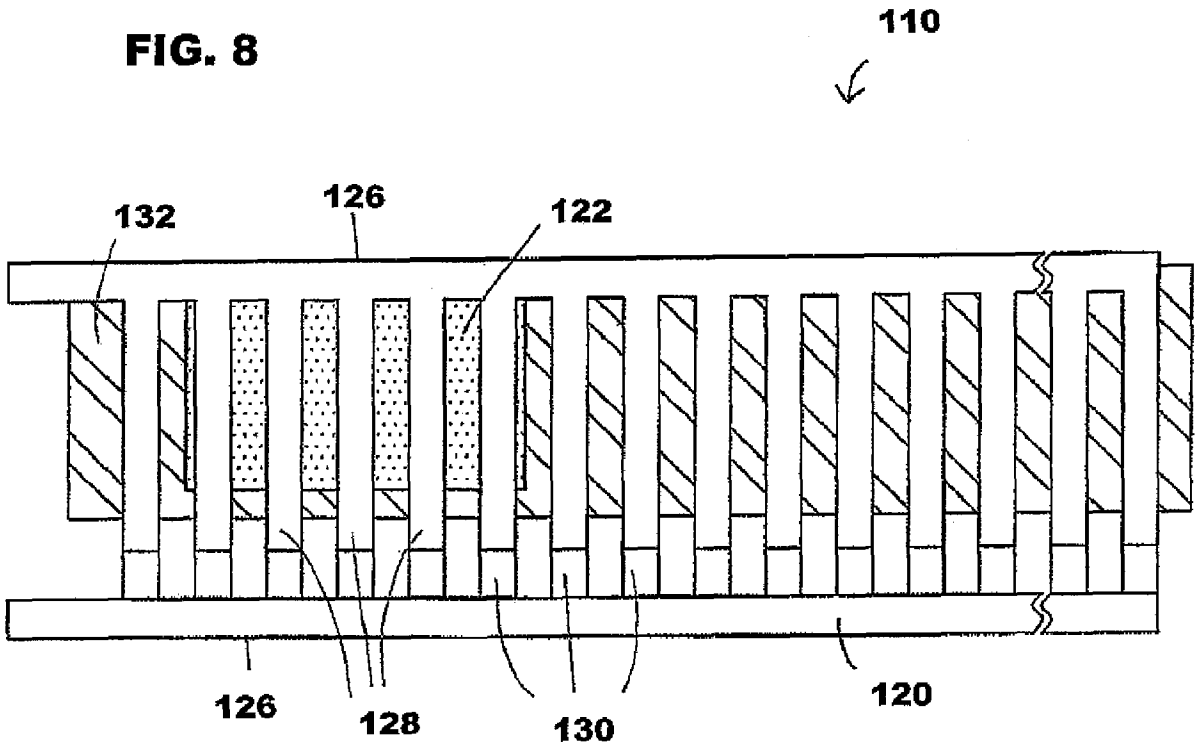
FIG. 8 is a side view of the electromagnetic launcher of FIG. 7.
Figure 9:
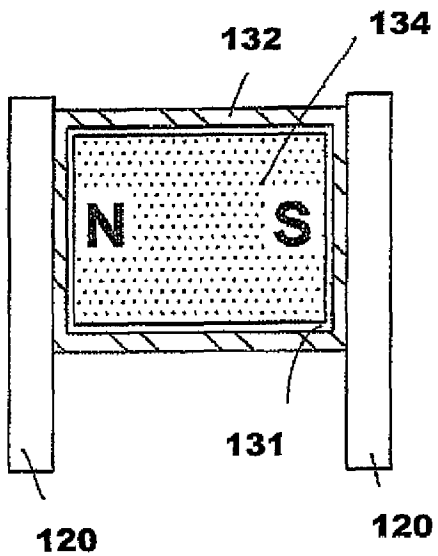
FIG. 9 is an end view of the electromagnetic launcher of FIG. 7.

Referring now to FIGS. 7-9, there is shown an electromagnetic launcher 110 according to another illustrative embodiment of the present invention, comprising a guide which includes a pair of electric ladders 120, each substantially similar to ladder 12 of the first embodiment, and a block-shaped projectile 122 arranged therebetween. As in the first illustrative embodiment, the each of the electric ladders 120 comprises a pair of electrically conductive, substantially parallel longitudinal rails 126 which are connected by a plurality of conductive rungs 128 with integral switches 130. The electric ladders 120 may each be constructed in substantially the same manner as the ladder 12.

According to the second illustrative embodiment, the projectile 122 may be formed in a substantially block-shape primarily including a permanent magnet 134. A protective restraint 132, may be provided which has a shape corresponding to that of the projectile in order to the projectile 122 along the electromagnetic launcher 110, may be provided. The restraint 132 may be formed of an appropriate non-conductive, low-friction material, may extend between, and may connect the two electric ladders 120. The projectile 122 may be positioned within the protective restraint 132 such that there is a small air gap 131 between the protective restraint 132 and the projectile 134. This small air gap 131 may allow small movement of the projectile 134 relative to the ladders 120. The restraint 132 generally maintains the projectile in the proper position between the ladders, but similar to the first embodiment, the projectile is mostly supported and move by Lorentz forces, such that there is little friction/contact between the projectile and the restraint.

As with the first illustrative embodiment, one of the longitudinal rails 126 of each of the electric ladders 120 may be electrically coupled to a positive terminal of an electrical power source (not shown) and the other longitudinal rail 126 of each of the electric ladders 120 may be electrically coupled to the negative terminal of an electrical power source/supply (not shown) such that a circuit may be completed through each of the ladders 120 to generate Lorentz forces which accelerate the projectile along the ladders until it reaches hypervelocity and is launched.

As with the first illustrative embodiment, the switches may be formed using a semiconductor magnetoresistive material so that when any one of the conductive rungs 128 are within the presence of the magnetic field created by the permanent magnet 134, the switches 130 provided with the rungs are activated and electrical current flows through the respective conductive rungs 128.

Figure 10:
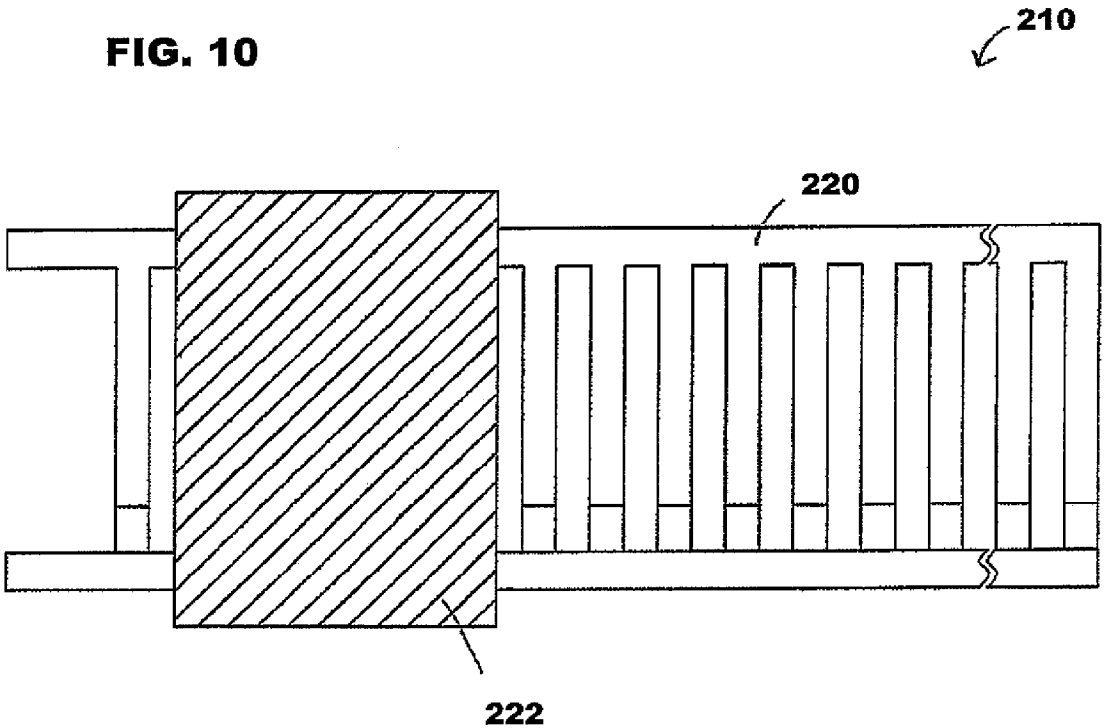
FIG. 10 is a side view of an electromagnetic launcher similar to FIG. 1, but with a box-shaped projectile according to another embodiment of the present invention.
Figure 11:
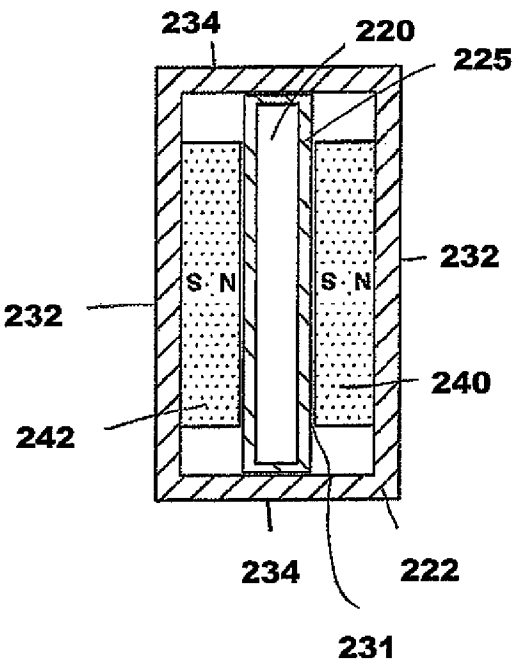
FIG. 11 is an end view of the electromagnetic launcher of FIG. 10.

Referring now to FIGS. 10 and 11, there is shown an electromagnetic launcher 210 according to another illustrative embodiment of the present invention, comprising an electric ladder or guide 220 which is essentially the same as the ladder 12 in the first embodiment. The structure of the electromagnetic launcher 210 of the of the third illustrative embodiment is essentially the same as the electromagnetic launcher disclosed above in the first illustrative embodiment. The structural differences include two sets of substantially parallel members 232, 232 and 234, 234 which form a main body having a box-shaped cross-section and, a coating or thin member of a non-conductive, low friction material 225 fully surrounding the ladder 220, in order to minimize any damage that may occur or heat which may be produced by any contact between the permanent magnets 240, 242 and the electric ladder 220. The box-shaped projectile 222 may be disposed such that there are small air gaps 231 between the permanent magnets 240, 242 and the electric ladder 220. The small air gaps 231 will, again, allow small movement of the projectile 222 relative to the ladder. The electromagnetic launcher 210 will function essentially the same as the launcher 10.

Figure 12:
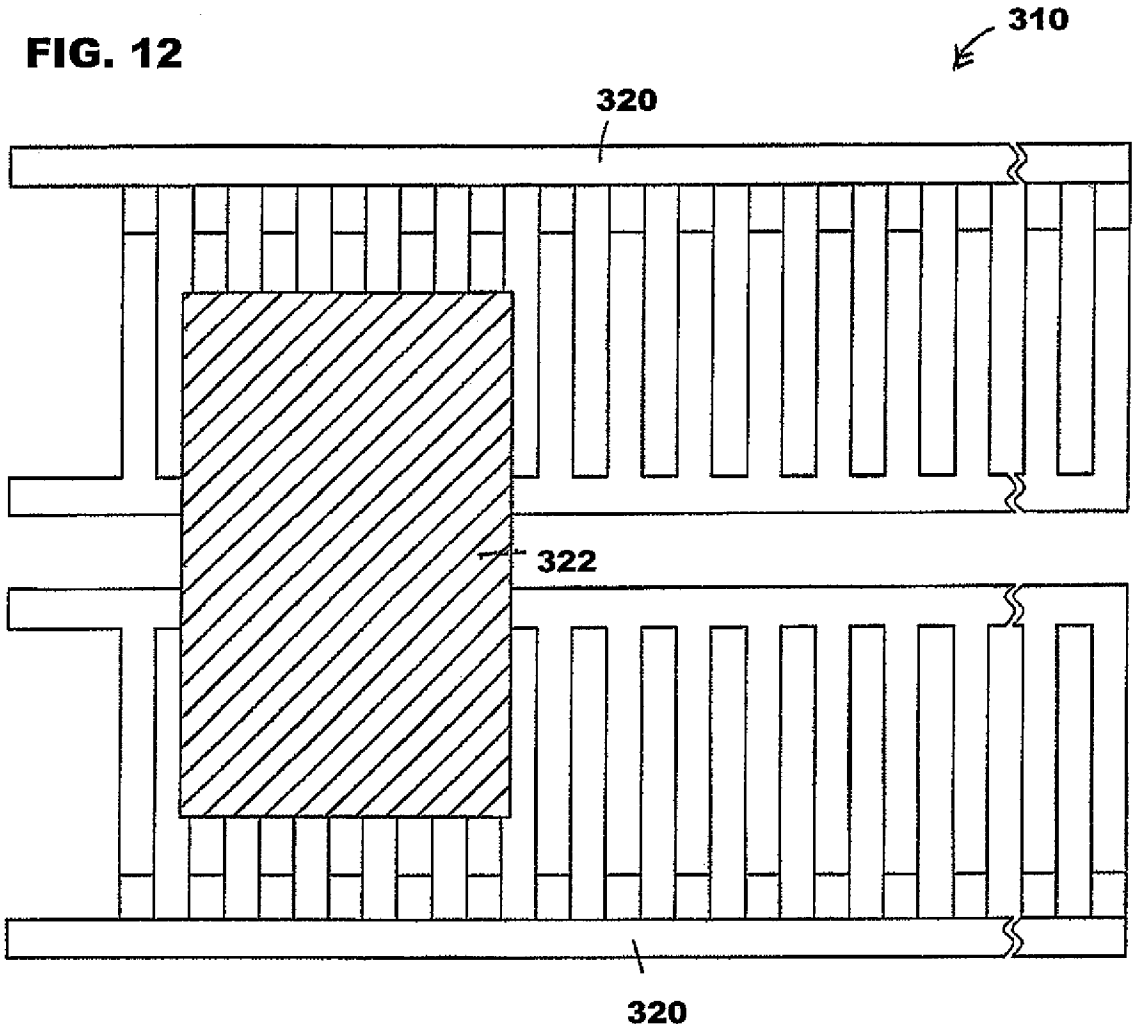
FIG. 12 is a side view of an electromagnetic launcher having a guide with a pair of electric ladders disposed vertically one above the other and an H-shaped projectile according to another embodiment of the present invention.
Figure 13:
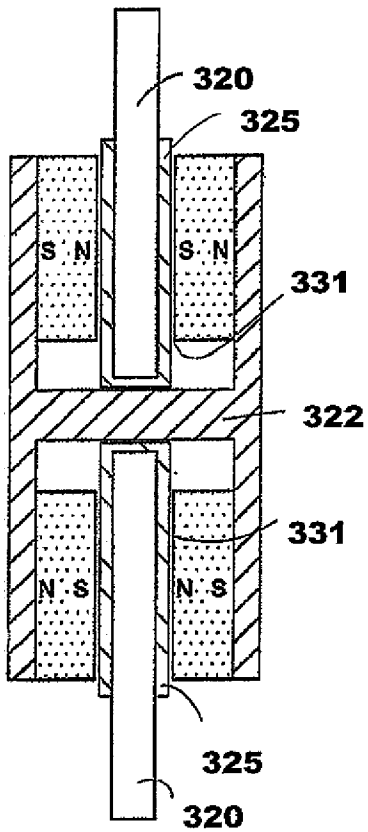
FIG. 13 is an end view of the electromagnetic launcher of FIG. 12.

Referring now to FIGS. 12 and 13, there is shown an electromagnetic launcher 310 according to another illustrative embodiment of the present invention, comprising a pair of electric ladders 320 spaced vertically, one above the other, each of which is substantially the same as the ladder 12 of the first embodiment, and an H-shaped projectile 322 arranged on the ladders 320, and which is effectively two of the U-shaped projectiles 14 of the first embodiment connected together back-to-back such that it opens both upwardly and downwardly. The electric ladders 320 are position between within the openings of the projectile 322. The sides of each electric ladder 320 which is disposed within the open portions of the H-shaped projectile 322 may be coated in a non-conductive, low friction material or member 325, in order to minimize any damage that may occur or heat which may be produced by any contact between the permanent magnets and the electric ladders 320. The H-shaped projectile 322 may be disposed such that there are small air gaps 331 between the open portions of the H-shaped projectile 322 and the electric ladders 320. These small air gaps 331 will allow small movement of the projectile 322 relative to the electric ladders. The workings of the electromagnetic launcher 310 of this illustrative embodiment are, again, essentially the same as the electric ladders and the electromagnetic launcher disclosed above in the first illustrative embodiment.

Figure 14:
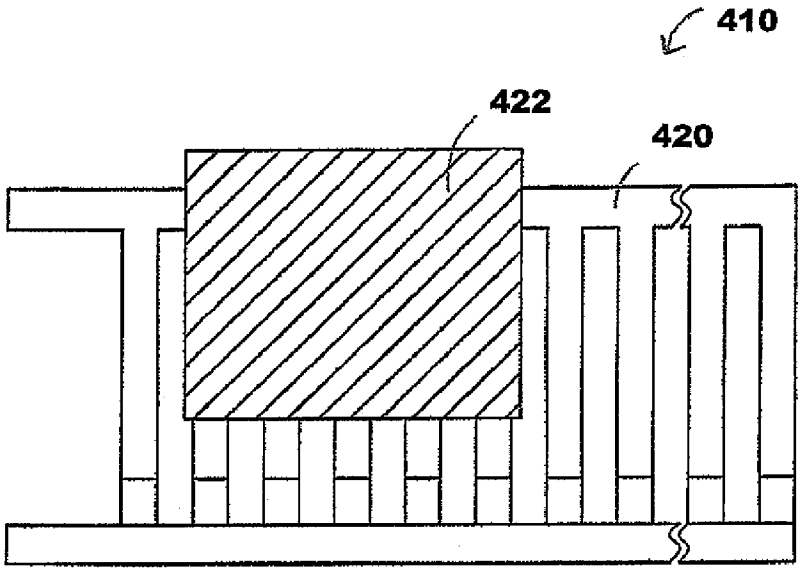
FIG. 14 is a side view of an electromagnetic launcher having a guide with three electric ladders disposed side-by-side and a projectile having multiple magnets according to another embodiment of the present invention.
Figure 15:
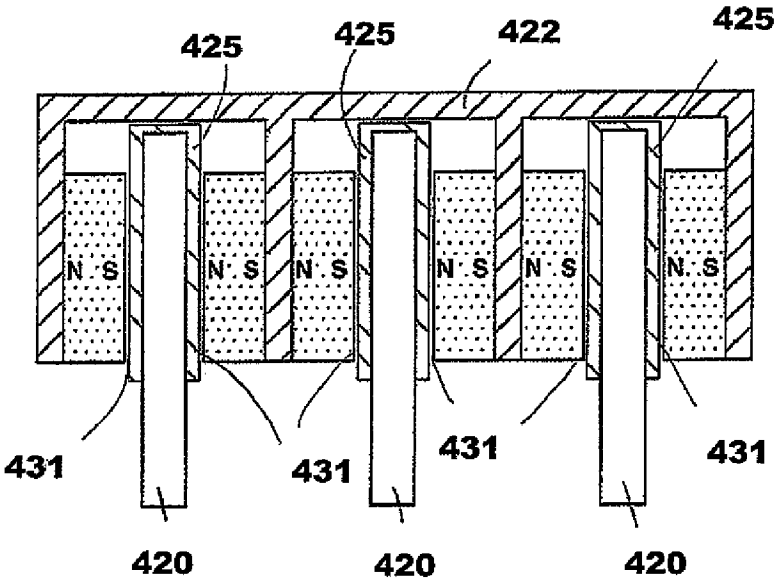
FIG. 15 is an end view of the electromagnetic launcher of FIG. 14.

Referring now to FIGS. 14 and 15, there is shown an electromagnetic launcher 410 according to another illustrative embodiment of the present invention, comprising a plurality of electric ladders 420 (three are depicted) each of which is essentially the same as the ladder 12 of the first illustrative embodiment, and a projectile 422 arranged on the ladders 420. The electric ladders 420 are arranged within the openings of the projectile 422. As with the above embodiments, the side of each electric ladder 420 which is placed within the open portion of the projectile 422 may be coated with a non-conductive, low friction material or member 425, in order to minimize any damage that may occur or heat which may be produced by any contact between the permanent magnets and the electric ladders 420. The projectile 422 may be arranged such that there are small air gaps 431 between the open portions of the projectile 422 and the electric ladders 420. These small air gaps 431 allow small movement of the projectile 422. Again, the workings of the electromagnetic launcher 410 of this illustrative embodiment are essentially the same as those of the electromagnetic launcher disclosed above in the first illustrative embodiment, although the number of electric ladders is increased and the projectile has a different shape, which is essentially a plurality of the projectiles 14 of the first illustrative embodiment joined side-by-side together.

As will be appreciated, other variations and arrangements of electric ladder(s) and projectile(s) may be provided which function similarly to the above-described embodiments, and the presented invention is intended to encompass these as well.

Figure 16:
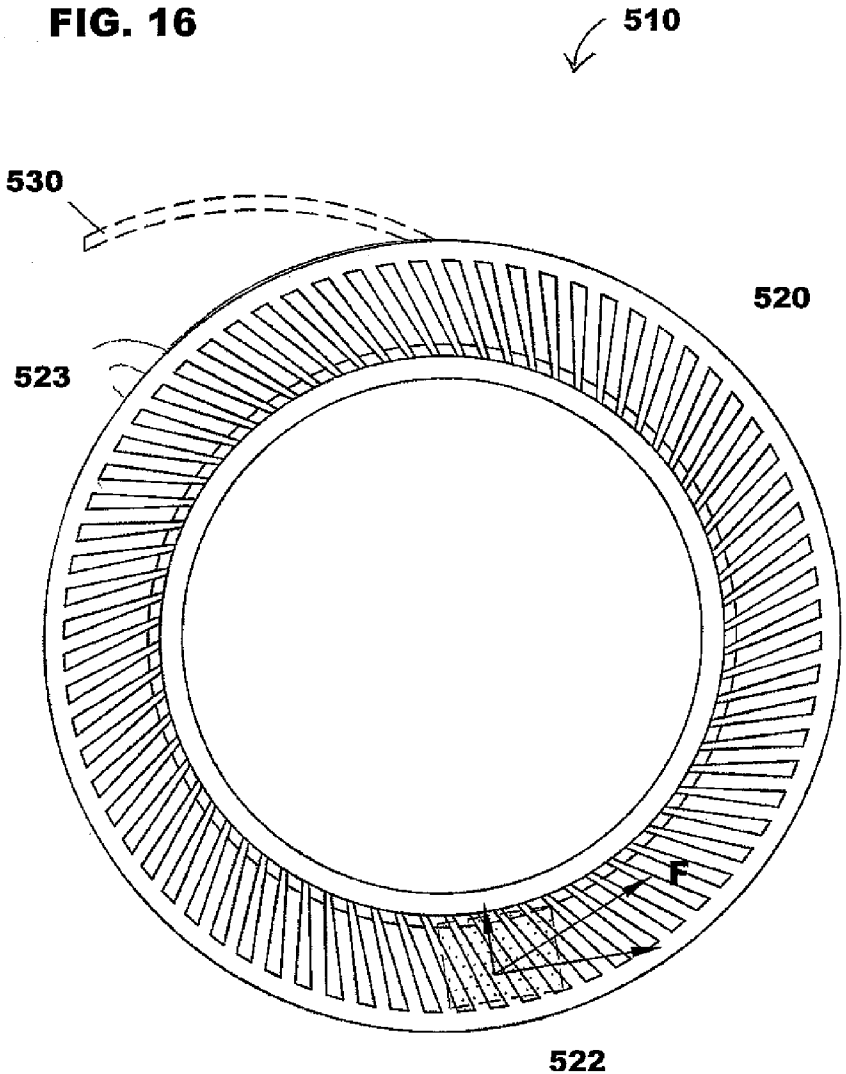
FIG. 16 is a top plan view of an electromagnetic launcher having a circular guide according to another embodiment of the present invention.
Figure 17:
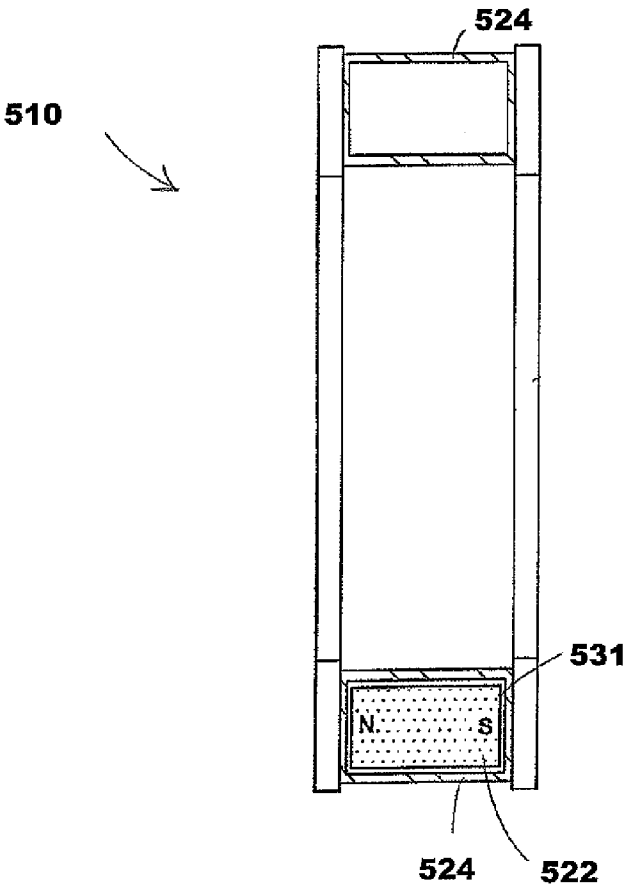
FIG. 17 is a sectional view taken along line 17-17 of FIG. 16.
Figure 18:
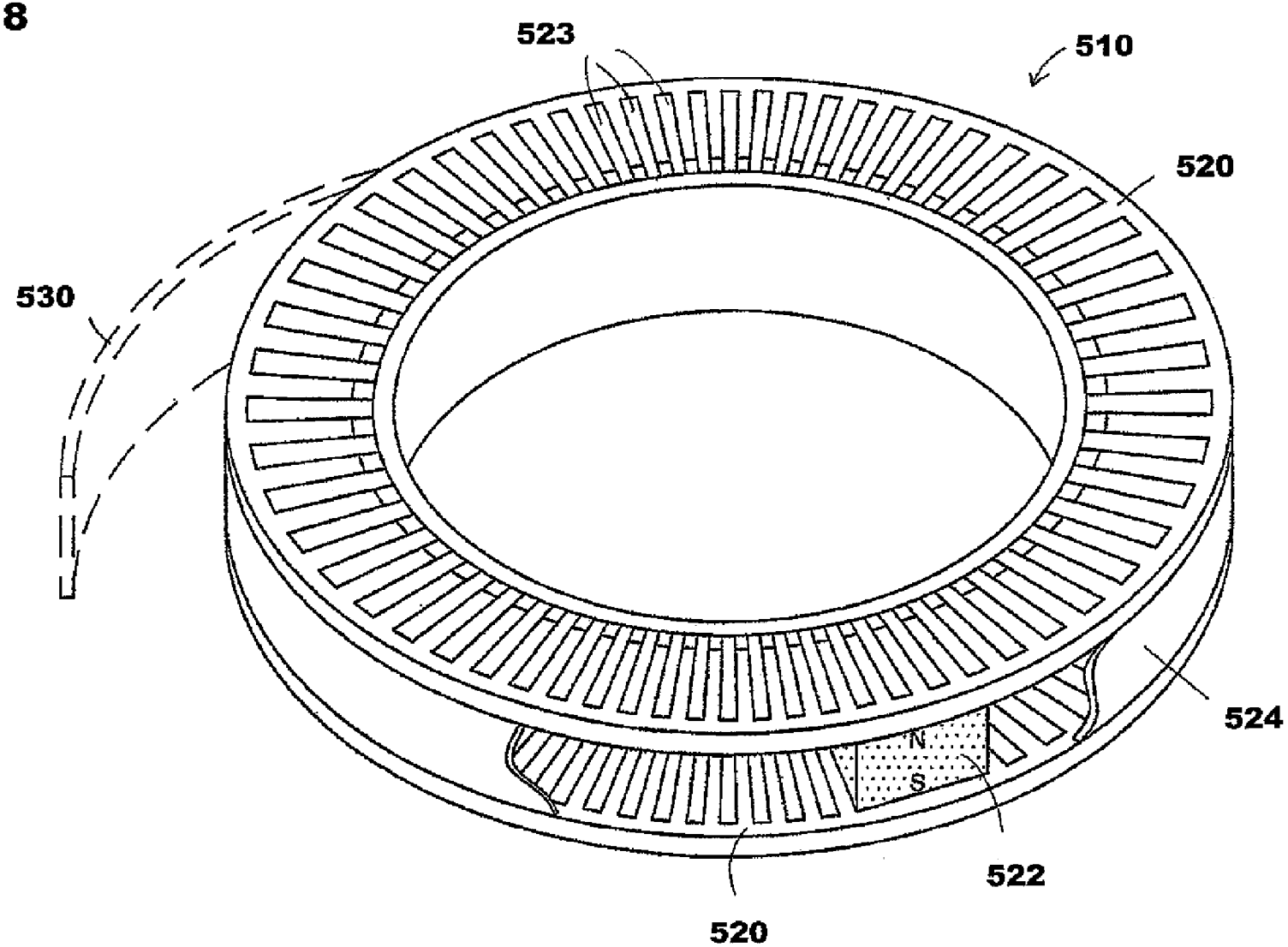
FIG. 18 is a perspective view of the electromagnetic launcher of FIG. 16.

Referring now to FIGS. 16-18, there is shown an electromagnetic launcher 510 according to another illustrative embodiment of the present invention, comprising a pair of electric ladders 520 shaped as annular rings, and a block-shaped projectile 522 arranged therebetween, and which primarily includes a permanent magnet. The electric workings of the electromagnetic launcher 510 of this illustrative embodiment are similar to the ladders and the electromagnetic launcher disclosed above in the first illustrative embodiment, although the ring shape of the electric ladders is quite different from the linearly extending ladders of the previous illustrative embodiments and involves some additional considerations.

According to this illustrative embodiment of the present invention, the electric ladders 520 are formed substantially in the shape of a circular, annular ring. A member 524 which may formed of a non-conductive, low friction material is disposed between and may contact the pair of electric ladders 520. The projectile 522 is arranged in the member 524 for being guided and restrained thereby, while the projectile 522 is moving and being accelerated within the electromagnetic launcher 510. The projectile 522 may be arranged such that there are small air gaps 531 between the member 524 and the projectile 522. These small air gaps 531 will allow small movement of the projectile 522 relative to the member 524.

In this embodiment, switches provided with the ladders 520 are sequentially activated similar to the switches in the first embodiment such that the projectile 522 moves/accelerates around and around the electromagnetic launcher until it achieves sufficiently high speed enabling it to be launched. Of course, this embodiment functions different than the above embodiment because the projectile will be accelerated by the same rungs of the ladders multiple times as the projectile goes around and around, but again only a small number of those switches will be activated, to make the associated rungs conductive, at any given time. Normally, the moving/accelerating projectile would have great centrifugal force associated therewith and directly, outwardly, but the launcher is modified from a perfectly circular shape to prevent this. As shown in FIG. 16, for example, the conductive rungs 523 of the electric ladders 520 may be slightly tilted toward the center of the electric ladder in order to ensure that part of the Lorentz force being exerted on the projectile 522 will generate a centripetal force directed somewhat toward the center of the circular ladder, for keeping the projectile 522 substantially centered within the member 524. Since the magnetic pushing force (Lorentz force) is directed perpendicular to the conductive rung, when the conductive rungs are tilted slightly, as shown, the Lorentz force is not directed perfectly tangential to the outer surface of the launcher, but, is in the direction shown by Arrow F. Such Lorentz force includes a primary velocity force which accelerates the projectile forward around the path of the launcher, and a smaller centripetal force directing the projectile toward the center of the circular electric ladders. Again, because the projectile moves inside the protective guide which restrains the projectile in a circular motion, a centrifugal force would normally act on the projectile, forcing the projectile away from the center of the circular electric ladder and against the wall of the protective guide. However, according to this embodiment, the centripedal force, created by the tilting of the ladder rungs can be determined/controlled by the amount of the tilting so as to offset or negate the centrifugal force, allowing the projectile to stay substantially centered in the launcher with little or no friction force against the outerwall of the protective guide member 524.

As with the above illustrative embodiments, the projectile 522 of this illustrative embodiment travels along the electromagnetic launcher 510 until the projectile reaches hypervelocity and is then launched from the electromagnetic launcher 510. However, since the electromagnetic launcher 510 is formed in a substantially circular shape, the projectile continuously travels around the circular form of the electromagnetic launcher until reaching hypervelocity. Once it is determined or sensed that the projectile 522 has reached a predetermined speed, a gate 530 may be opened, thereby creating an opening through which the projectile may be conveniently launched. The speed of the projectile may be monitored using any appropriate device, such as sensors or the like, either contained within the electromagnetic launcher 510 or positioned away from and separate from the electromagnetic launcher 510. The gate may be opened using a switching mechanism or the like.

According to a modification of this embodiment, in an effort to decrease the cost and complexity of the electromagnetic launcher, instead of having sensors which monitor the speed of the projectile 522, and disconnect power to the electromagnetic launcher 510 and opens gate 530, gate 530 may be automatically opened after a preset time from the beginning of a launching operation, which preset time may be established based on experimentation.

Figure 19:
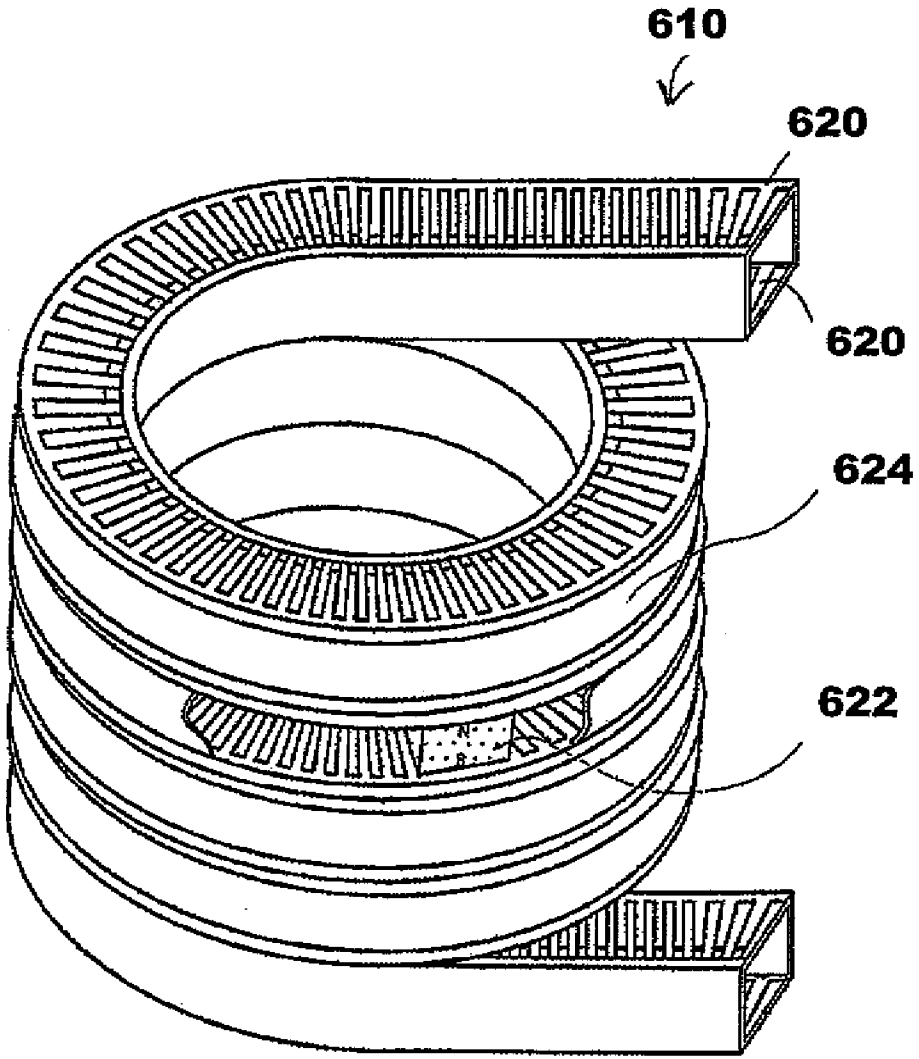
FIG. 19 is a perspective view showing an electromagnetic launcher having a helical ladder according to an other embodiment of the present invention.

Referring now to FIG. 19, there is shown an electromagnetic launcher 610 according to still another illustrative embodiment of the present invention, comprising a pair of electric ladders 620 having a substantially helical shape and a block-shaped projectile 622 arranged therebetween. The workings of the electromagnetic launcher 610 are similar to those of the electromagnetic launcher 510 disclosed in FIGS. 16-18.

A member 624 which may be formed of a non-conductive, low friction material is arranged between and may connect the plurality of electric ladders 620. The member 624 functions to restrict and guide the projectile as it accelerates between the ladders. The projectile 622 primarily includes a permanent magnet. The projectile 622 may be disposed such that there are small air gaps between the member 624 and the projectile 622. These air gaps are allow small movements of the projectile 622 relative to the launcher.

As in the embodiment shown in FIGS. 16-18, the rungs of the ladders will be somewhat tilted so that they are not exactly perpendicular to the rails of the ladder, so as to create a centripetal force that offsets centrifugal forces of the rotating projectile.

Both the embodiment wherein the electric ladder is formed in a circular, annular ring, as shown in FIGS. 16-18, and the embodiment wherein the electric ladder is formed in a helical shape, as shown in FIG. 19, are advantageous in that they allow the projectile to travel a longer distance over a smaller space. For example, as shown in the calculations above going to the looped conductive rung ladder structure-type electromagnetic launcher, in order to reach a muzzle speed of 7 kilometers per second, the length of the electromagnetic launcher would need to be 2.5 kilometers. However, if the electromagnetic launcher were to be formed in an annular ring or in a helical shape, the projectile could travel the required 2.5 kilometers without requiring the electromagnetic launcher to have a length of 2.5 kilometers.

The present invention is not limited in its application to the details of construction and to the dispositions of the components set forth in the foregoing description or illustrated in the appended drawings in association with the present illustrative embodiments of the invention. The present invention is capable of other embodiments and of being practiced and carried out in various ways. In addition, it is to be understood that the phraseology and terminology employed herein are for the purposes of illustration and example, and should not be regarded as limiting.

As such, those skilled in the art will appreciate that the concepts, upon which this disclosure is based, may readily be utilized as a basis for the designing of other structures, methods and systems for carrying out the several purposes of the present invention. It is important, therefore, that the claims be regarded as including such equivalent constructions. For example, the projectile could, instead of directly being placed along/around the rails and conductive rungs, an armature could be placed on the rails and conductive rungs and the projectile could then be fashioned to the armature using conventional securing methods. As a further example, the permanent magnets disclosed above within the projectiles, may be replaced by an electromagnet with a self-contained power supply.

As still a further example, looped conductive rungs and single turn rungs may be combined within a single electromagnetic launcher according to the present invention. In such a design, the looped conductive rungs may be used at the beginning of the electric ladder, where the projectile is moving at a relatively low velocity, in order to achieve a maximum accelerating force. In intermediate portions of the ladder the number of loops in each rung may be progressively reduced, and in the later parts of the electric ladder where the projectile is moving at comparatively higher velocities, single turn rungs may be used in order to minimize the inductance on the projectile.

Although the present invention has been described herein with respect to a number of specific illustrative embodiments, the foregoing description is intended to illustrate, rather than to limit the invention. Those skilled in the art will realize that many modifications of the preferred embodiment could be made which would be operable. All such modifications, which are within the scope of the claims, are intended to be within the scope and spirit of the present invention.

What is claimed is:

1. A channel gun electromagnetic launcher comprising:

an electric power supply;

a conductive, stationary guide operatively connected to the power supply and forming a flowpath for current from the power supply; and a non-conductive projectile disposed adjacent to the guide and which is accelerated along the guide when current flows through the guide;

the guide including a plurality of rails disposed in spaced, substantially parallel relation to each other, a plurality of rungs interconnecting the rails and disposed in spaced relation to each other along the rails, and switches operatively associated with the rungs for selectively permitting current flow through different ones of the rungs;

the projectile including a main body and a magnet supported by the main body such that the magnet faces the guide with a small gap therebetween; and wherein the switches are passively activated when they are disposed within a magnetic field of the projectile, such that the switches are sequentially activated as the projectile moves along the guide and create an electromagnetic pushing force which continuously accelerates the projectile along the guide substantially in a direction parallel to the guide.

2. The channel gun electromagnetic launcher according to claim 1, wherein the rails are elongate, substantially linear members, and the rungs extend substantially perpendicular to the rails.

3. The channel gun electromagnetic launcher according to claim 1, wherein the rails have a substantially circular shape, and the rungs are substantially linear members oriented at an angle other than 90° relative to the rails.

4. The channel gun electromagnetic launcher according to claim 3, wherein the rails are formed as annular rings.

5. The channel gun electromagnetic launch according to claim 4, further comprising a mechanism which releases the projectile after a predetermined amount of time has passed or after a predetermined speed has been reached.

6. The channel gun electromagnetic launcher according to claim 3, wherein the rails are formed with a helical shape.

7. The channel gun electromagnetic launcher according to claim 1, wherein the magnet is one of a permanent magnet and an electromagnet with an on-board power source.

8. The channel gun electromagnetic launcher according to claim 1, wherein a surface of at least one of the guide and the projectile is formed with a material having a low coefficient of friction, to thereby reduce any friction caused by engagement of the projectile and the guide as the projectile is accelerated along the guide.

9. The channel gun electromagnetic launcher according to claim 1, wherein the switches are provided integrally with the rungs respectively, and are formed with semiconductor material which selectively allows current flow through the associated rungs only when the switches are disposed within a magnetic field of the projectile.

10. The channel gun electromagnetic launcher according to claim 9, wherein the switches are formed with a magnetoresistive semiconductor material.

11. The channel gun electromagnetic launcher according to claim 1, wherein the rungs are formed in a loop.

12. A channel gun electromagnetic launcher comprising:

an electric power supply;

a conductive, stationary guide operatively connected to the power supply and forming a flowpath for current from the power supply, the guide including a plurality of rails disposed in spaced, substantially parallel relation to each other, and a plurality of rungs interconnecting the rails and disposed in spaced relation to each other along the rails;

a non-conductive projectile disposed adjacent to the guide and which is accelerated along the guide when current flows through the guide, the projectile including a main body and a magnet supported by the main body such that the magnet faces the guide with a small gap therebetween;

switches operatively associated with the rungs for selectively permitting current flow through different ones of the rails; and a controller which selectively activates the switches when they are disposed in close proximity to the projectile, such that the switches are sequentially activated as the projectile moves along the guide and create an electromagnetic pushing force which continuously accelerates the projectile along the guide substantially in a direction parallel to the guide.

13. The channel gun electromagnetic launcher according to claim 12, further comprising a sensing mechanism for sensing a position of the projectile along the guide, and which outputs a signal to the controller indicative of the projectile's position.

14. The channel gun electromagnetic launcher according to claim 12, wherein the rails are elongate, substantially linear members, and the rungs extend substantially perpendicular to the rails.

15. The channel gun electromagnetic launcher according to claim 12, wherein the rails have a substantially circular shape, and the rungs are substantially linear members oriented at an angle other than 90° relative to the rails.

16. The channel gun electromagnetic launcher according to claim 15, wherein the rails are formed as annular rings.

17. The channel gun electromagnetic launch according to claim 16, further comprising a mechanism which releases the projectile after a predetermined amount of time has passed or after a predetermined speed has been reached.

18. The channel gun electromagnetic launcher according to claim 15, wherein the rails are formed with a helical shape.

19. The channel gun electromagnetic launcher according to claim 12, wherein the magnet is one of a permanent magnet and an electromagnet with an on-board power source.

20. The channel gun electromagnetic launcher according to claim 12, wherein a surface of at least one of the guide and the projectile is formed with a material having a low coefficient of friction, to thereby reduce any friction caused by engagement of the projectile and the guide as the projectile is accelerated along the guide.

* * * * *